US008979482B2

(12) United States Patent
Khanin et al.

(10) Patent No.: US 8,979,482 B2
(45) Date of Patent: Mar. 17, 2015

(54) GAS TURBINE OF THE AXIAL FLOW TYPE

(75) Inventors: Alexander Anatolievich Khanin, Moscow (RU); Valery Kostege, Moscow (RU)

(73) Assignee: Alstom Technology Ltd., Baden (CH)

( * ) Notice: Subject to any disclaimer, the term of this patent is extended or adjusted under 35 U.S.C. 154(b) by 607 days.

(21) Appl. No.: 13/306,025

(22) Filed: Nov. 29, 2011

(65) Prior Publication Data

US 2012/0134779 A1 May 31, 2012

(30) Foreign Application Priority Data

Nov. 29, 2010 (RU) ..... 2010148727

(51) Int. Cl.
*F01D 11/10* (2006.01)

(52) U.S. Cl.
CPC ..... *F01D 11/10* (2013.01); *F05D 2240/11* (2013.01); *F05D 2260/201* (2013.01); *F05D 2260/205* (2013.01); *F05D 2240/81* (2013.01)
USPC ..... 415/115; 415/191

(58) Field of Classification Search
USPC ..... 415/115, 116, 108, 191, 177, 170.1, 415/173.1, 173.5, 173.6, 174.5; 416/96 R, 416/97 R, 97 A, 96 A
See application file for complete search history.

(56) References Cited

U.S. PATENT DOCUMENTS 3,807,891 A * 4/1974 McDow et al. ..... 415/116
4,005,946 A * 2/1977 Brown et al. ..... 415/136
4,303,371 A * 12/1981 Eckert ..... 415/116
4,311,431 A * 1/1982 Barbeau ..... 415/173.6
4,329,114 A * 5/1982 Johnston et al. ..... 415/145
4,522,557 A * 6/1985 Bouiller et al. ..... 415/115
4,541,775 A * 9/1985 Hovan ..... 415/180
4,573,865 A * 3/1986 Hsia et al. ..... 415/115
4,702,670 A * 10/1987 Winter ..... 415/116
5,340,274 A * 8/1994 Cunha ..... 415/115
5,899,660 A * 5/1999 Dodd ..... 415/9
5,993,150 A * 11/1999 Liotta et al. ..... 415/115
6,254,345 B1 * 7/2001 Harris et al. ..... 416/96 R (Continued)

FOREIGN PATENT DOCUMENTS

CN 1568397 A 1/2005
DE 10156193 A1 * 6/2003 ..... F01D 9/00

(Continued)

OTHER PUBLICATIONS

Gombert, Ralf Partial European Search Report to EP application 11 19 0892 dated Mar. 1, 2012.*

(Continued)

*Primary Examiner* — Nathaniel Wiehe
*Assistant Examiner* — Wayne A Lambert
(74) *Attorney, Agent, or Firm* — Buchanan Ingersoll & Rooney PC

(57) ABSTRACT

In an axial flow gas turbine (30), a reduction in cooling air mass flow and leakage in combination with an improved cooling and effective thermal protection of critical parts within the turbine stages of the turbine is achieved by providing, within a turbine stage (TS), devices (43-48) to direct cooling air that has already been used to cool, especially the airfoils of the vanes (31) of the turbine stage (TS), into a first cavity (41) located between the outer blade platforms (34) and the opposed stator heat shields (36) for protecting the stator heat shields (36) against the hot gas and for cooling the outer blade platforms (34).

14 Claims, 5 Drawing Sheets

(56) References Cited

U.S. PATENT DOCUMENTS

| | | | | |
|---|---|---|---|---|
| 6,431,820 | B1 * | 8/2002 | Beacock et al. | 415/1 |
| 6,638,012 | B2 * | 10/2003 | Bekrenev | 415/115 |
| 6,742,783 | B1 * | 6/2004 | Lawer et al. | 277/416 |
| 6,899,518 | B2 | 5/2005 | Lucas et al. | |
| 7,104,751 | B2 * | 9/2006 | Naik et al. | 415/116 |
| 7,273,347 | B2 * | 9/2007 | Rathmann | 415/173.6 |
| 2002/0085909 | A1 | 7/2002 | Bekrenev | |
| 2002/0122716 | A1 | 9/2002 | Beacock et al. | |
| 2003/0035722 | A1 | 2/2003 | Barrett et al. | |
| 2004/0120803 | A1 | 6/2004 | Lucas et al. | |
| 2004/0258523 | A1 * | 12/2004 | Naik et al. | 416/116 |
| 2005/0031446 | A1 | 2/2005 | Ress, Jr. et al. | |
| 2009/0081027 | A1 * | 3/2009 | Khanin et al. | 415/170.1 |
| 2009/0214328 | A1 * | 8/2009 | Tibbott et al. | 415/115 |
| 2012/0257954 | A1 * | 10/2012 | Chanteloup et al. | 415/1 |

FOREIGN PATENT DOCUMENTS

| | | | | |
|---|---|---|---|---|
| EP | 1213444 | A2 * | 6/2002 | F01D 25/12 |
| EP | 1219788 | A2 * | 7/2002 | F01D 11/08 |
| WO | WO 02070867 | A1 * | 9/2002 | |
| WO | 2004/057159 | A1 | 7/2004 | |
| WO | WO 2011076712 | A1 * | 6/2011 | |

OTHER PUBLICATIONS

Office Action/Search Report issued on Jul. 1, 2014, by the Chinese Patent Office in corresponding Chinese Patent Application No. 201110407962.5 and an English translation of the Office Action/Search Report. (14 pages).

* cited by examiner

GAS TURBINE OF THE AXIAL FLOW TYPE

This application claims priority under 35 U.S.C. §119 to Russian Federation application no. No. 2010148727, filed 29 Nov. 2010, the entirety of which is incorporated by reference herein.

BACKGROUND

1. Field of Endeavor

The present invention relates to the technology of gas turbines, and more specifically to a gas turbine of the axial flow type.

More specifically, the invention relates to designing a stage of an axial flow turbine for a gas turbine unit. Generally the turbine stator includes a vane carrier with slots where a row of vanes and a row of stator heat shields are installed one after another. The same stage includes a rotor having a rotating shaft with slots where a row of rotor heat shields and a row of blades are installed one after another.

2. Brief Description of the Related Art

This disclosure relates to a gas turbine of the axial flow type, an example of which is shown in FIG. 1. The gas turbine 10 of FIG. 1 operates according to the principle of sequential combustion. It includes a compressor 11, a first combustion chamber 14 with a plurality of burners 13 and a first fuel supply 12, a high-pressure turbine 15, a second combustion chamber 17 with a second fuel supply 16, and a low-pressure turbine 18 with alternating rows of blades 20 and vanes 21, which are arranged in a plurality of turbine stages arranged along the machine axis 22.

The gas turbine 10 according to FIG. 1 has a stator and a rotor. The stator includes a vane carrier 19 with the vanes 21 mounted therein; these vanes 21 are necessary to form profiled channels where hot gas developed in the combustion chamber 17 flows through. Gas flowing through the hot gas path 29 in the required direction hits against the blades 20 installed in shaft slits of a rotor shaft and causes the turbine rotor to rotate. To protect the stator housing against the hot gas flowing above the blades 20, stator heat shields installed between adjacent vane rows are used. High temperature turbine stages require cooling air to be supplied into vanes, stator heat shields, and blades.

A section of a typical air-cooled gas turbine stage TS of a gas turbine 10 is shown in FIG. 2. Within a turbine stage TS of the gas turbine 10, a row of vanes 21 is mounted on the vane carrier 19. Downstream of the vanes 21 a row of rotating blades 20 is provided each of which has at its tip an outer platform 24 with teeth (52 in FIG. 3(B)) arranged on the upper side. Opposite to the tips (and teeth 52) of the blades 20, stator heat shields 26 are mounted on the vane carrier 19. Each of the vanes 21 has an outer vane platform 25. The vanes 21 and blades 20 with their respective outer platforms 25 and 24 border a hot gas path 29, through which the hot gases from the combustion chamber flow.

To ensure operation of such a high temperature gas turbine 10 with long-term life span, all parts forming its flow path 29 should be cooled effectively. Cooling of turbine parts is realized using air fed from the compressor 11 of the gas turbine unit. To cool the vanes 21, compressed air is supplied from a plenum 23 through the holes 27 into the cavity 28 located between the vane carrier 19 and outer vane platforms 25. Then the cooling air passes through the vane airfoil and flows out of the airfoil into the turbine flow path 29 (see horizontal arrows at the trailing edge of the airfoil in FIG. 2). The blades 20 are cooled using air which passes through the blade shank and airfoil in vertical (radial) direction, and is discharged into the turbine flow path 29 through a blade airfoil slit and through an opening between the teeth 52 of the outer blade platform 24. Cooling of the stator heat shields 26 is not specified in the design presented in FIG. 2 because the stator heat shields 26 are considered to be protected against a detrimental effect of the main hot gas flow by the outer blade platform 24.

Disadvantages of the above described design can be considered to include, firstly, the fact that cooling air passing through the blade airfoil does not provide cooling efficient enough for the outer blade platform 24 and thus its long-term life span. The opposite stator heat shield 26 is also protected insufficiently against the hot gas from the hot gas path 29.

Secondly, a disadvantage of this design is the existence of a slit within the zone A in FIG. 2, since cooling air leakage occurs at the joint between the vane 21 and the subsequent stator heat shield 26, resulting in a loss of cooling air, which enters into the turbine flow path 29.

SUMMARY

One of numerous aspects of the present invention includes a gas turbine with a turbine stage cooling scheme, which can avoid drawbacks of the known cooling configuration and combines a reduction in cooling air mass flow and leakage with an improved cooling and effective thermal protection of critical parts within the turbine stages of the turbine.

Another aspect includes a rotor with alternating rows of air-cooled blades and rotor heat shields, and a stator with alternating rows of air-cooled vanes and stator heat shields mounted on a vane carrier, whereby the stator coaxially surrounds the rotor to define a hot gas path in between, such that the rows of blades and stator heat shields, and the rows of vanes and rotor heat shields, are opposite to each other, respectively, and a row of vanes and the next row of blades in the downstream direction define a turbine stage, and whereby the blades are provided with outer blade platforms at their tips. Means are provided within a turbine stage to direct cooling air that has already been used to cool, especially the airfoils of, the vanes of the turbine stage, into a first cavity located between the outer blade platforms and the opposed stator heat shields for protecting the stator heat shields against the hot gas and for cooling the outer blade platforms.

According to an exemplary embodiment, the outer blade platforms are provided on their outer side with parallel teeth extending in the circumferential direction, and said first cavity is bordered by said parallel teeth.

According to another embodiment, the vanes each comprise an outer vane platform, the directing means comprises a second cavity for collecting the cooling air, which exits the vane airfoil, and the directing means further comprises means for discharging the collected cooling air radially into said first cavity.

Preferably, the discharging means comprises a projection at the rear wall of the outer vane platform, which overlaps the first teeth in the flow direction of the adjacent outer blade platforms, and a screen, which covers the projection such that a channel for the cooling air is established between the projection and the screen, which ends in a radial slot just above the first cavity.

According to another embodiment, the second cavity and the discharging means are connected by a plurality of holes, which pass the rear wall of the outer vane platform and are equally spaced in the circumferential direction.

According to another embodiment, the second cavity is separated from the rest of the outer vane platform by a shoulder, and the second cavity is closed by a sealing screen.

BRIEF DESCRIPTION OF THE DRAWINGS

The present invention is now to be explained more closely by means of different embodiments and with reference to the attached drawings.

DETAILED DESCRIPTION OF EXEMPLARY EMBODIMENTS

Figure 3:
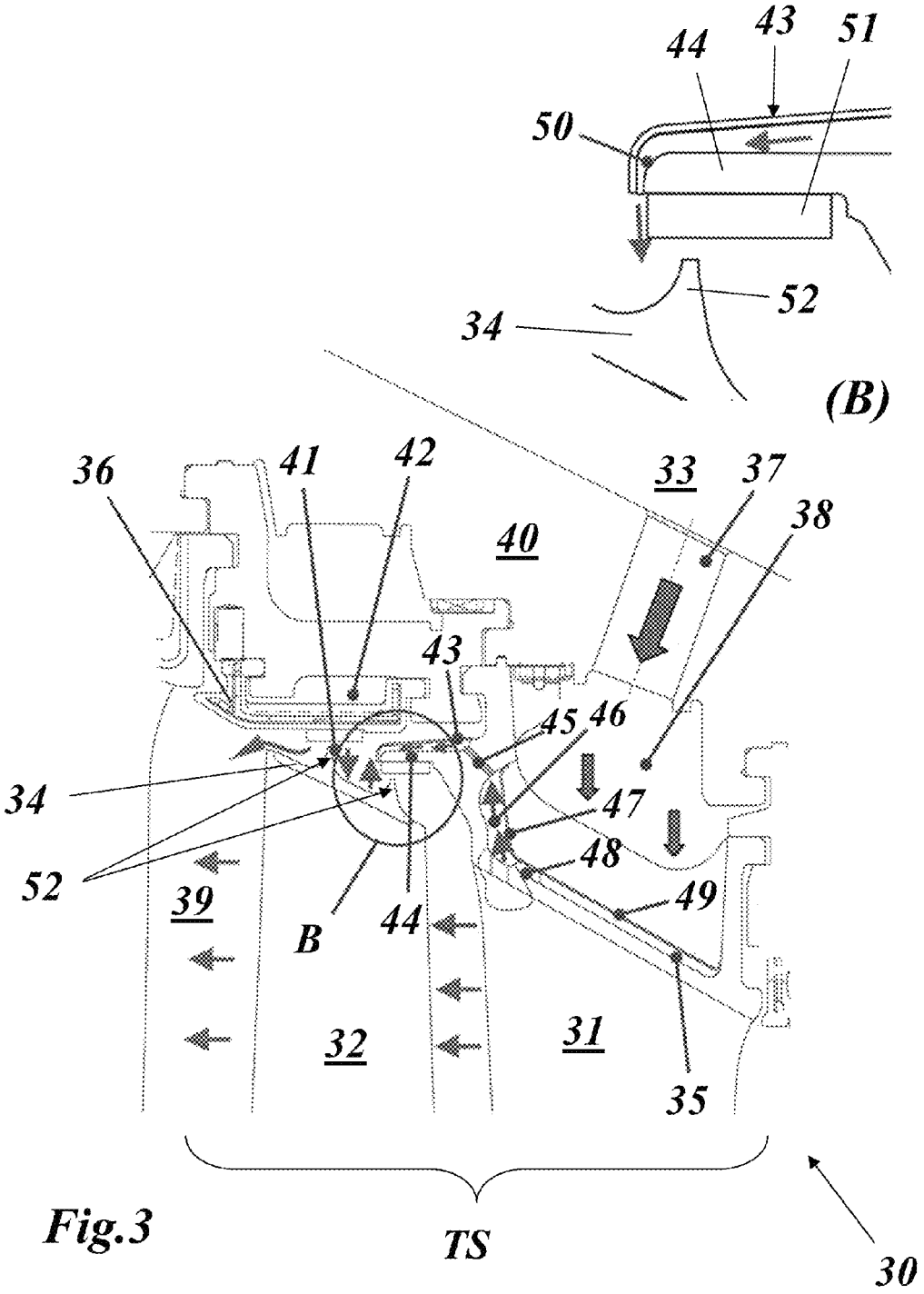
FIG. 3 shows cooling details of a turbine stage of a gas turbine according to an embodiment of the invention.

FIG. 3 shows cooling details of a turbine stage of a gas turbine 30 according to an exemplary embodiment and demonstrates the proposed design of the turbine stages TS, where cooling air is saved due to utilization of air used up in the vanes 31. A novelty of this includes not only cooling air savings, but also effective protection of the outer blade platform 34 against hot gas from the hot gas path 39, due to a continuous sheet of cooling air discharged vertically from the slit (50 in FIG. 3(B)) into a cavity 41 between parallel teeth 52 on the upper side of the outer blade platforms 34 of the blades 32 with an a turbine stage TS. The slit 50 is formed by a screen 43 covering a projection 44 at the rear wall of the outer vane platform 35 (see FIG. 3, zone B, and FIG. 3(B)).

In general, cooling air from the plenum 33 flows into cavity 38 through the cooling air hole 37, passes a perforated screen 49 and enters the cooling channels in the interior of the vane airfoil. The cooling air used up in the vane 31 for cooling passes from the airfoil into a cavity 46 partitioned off from the basic outer vane platform 35 by a shoulder 48 (see also FIG. 4). Then, this air is distributed from the cavity 46 into a row of holes 45 equally spaced in the circumferential direction. The cavity 46 is closed with sealing screen 47 (see also FIG. 5). As already mentioned above, perforated screen 49 (see FIG. 5) is situated above the remaining largest portion of the outer vane platform 35, and air is supplied through the holes in this screen to cool the platform surface and to enter the internal vane airfoil cavity (not shown in the figures).

Figure 1:
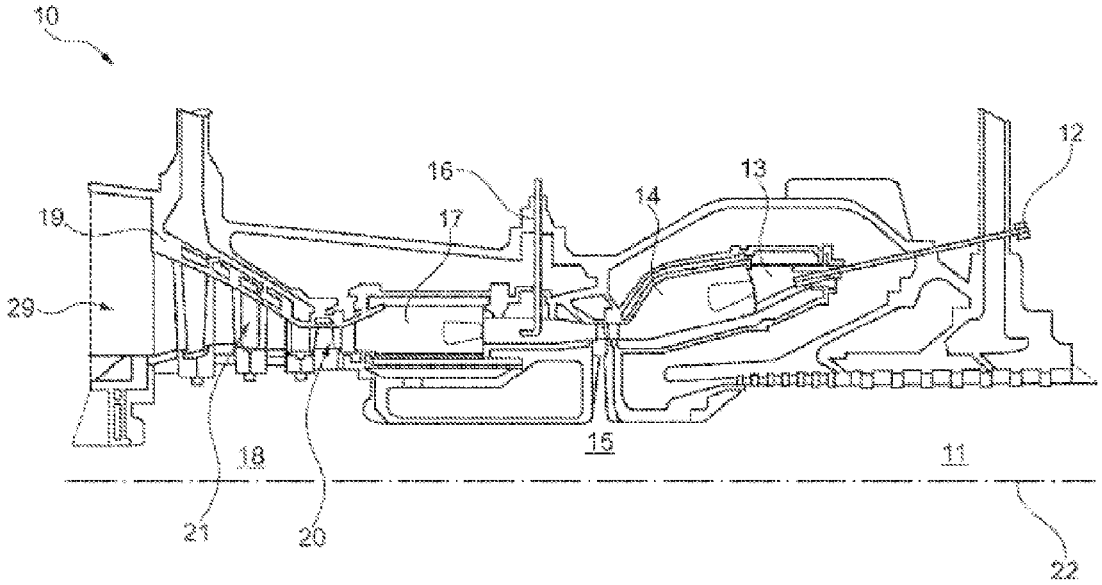
PRIOR ART FIG. 1
FIG. 1 shows a well-known basic design of a gas turbine with sequential combustion, which may be used with embodiments in accordance with the invention.
Figure 2:
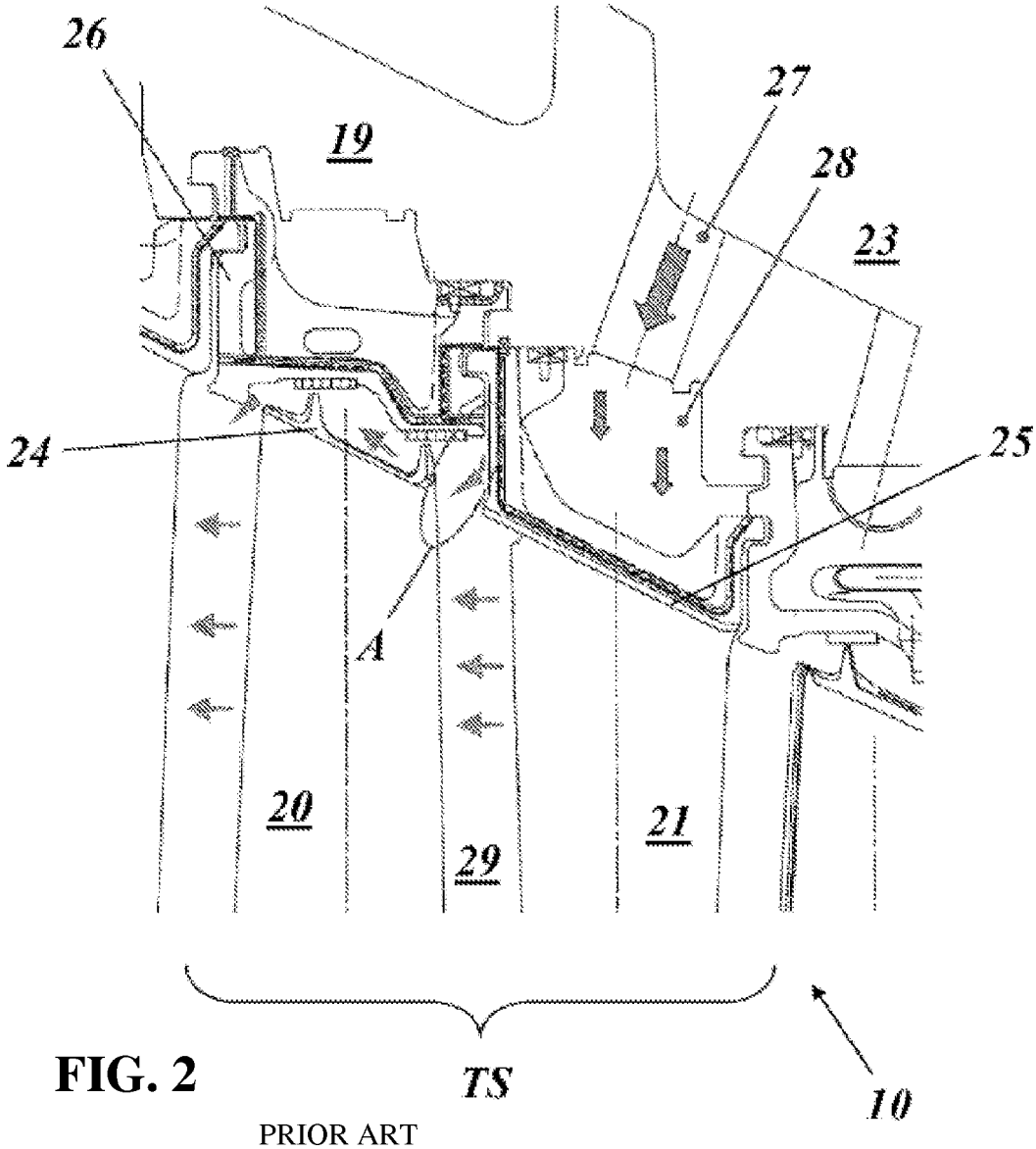
FIG. 2 PRIOR ART
FIG. 2 shows cooling details of a turbine stage of a gas turbine according to the prior art.
Figure 4:
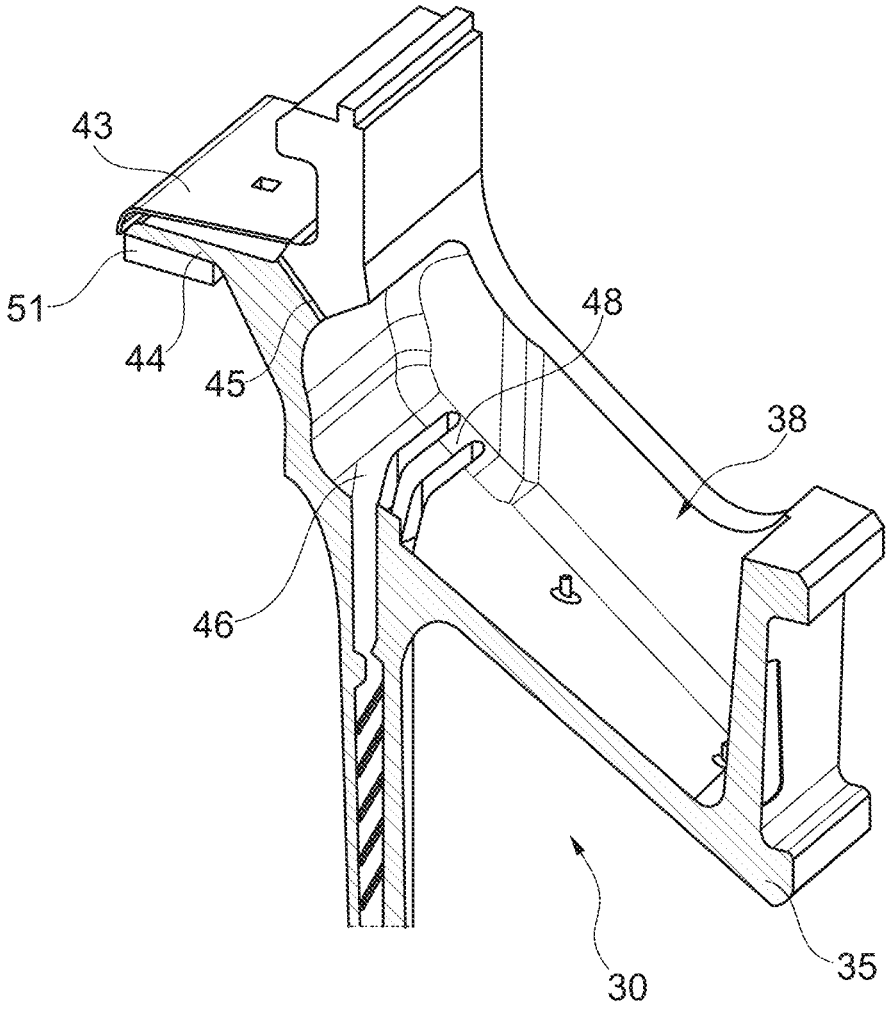
FIG. 4 shows, in a perspective view, the configuration of the outer platform of the vane of FIG. 3 in accordance with an embodiment of the invention, whereby all of the screens are removed.
Figure 5:
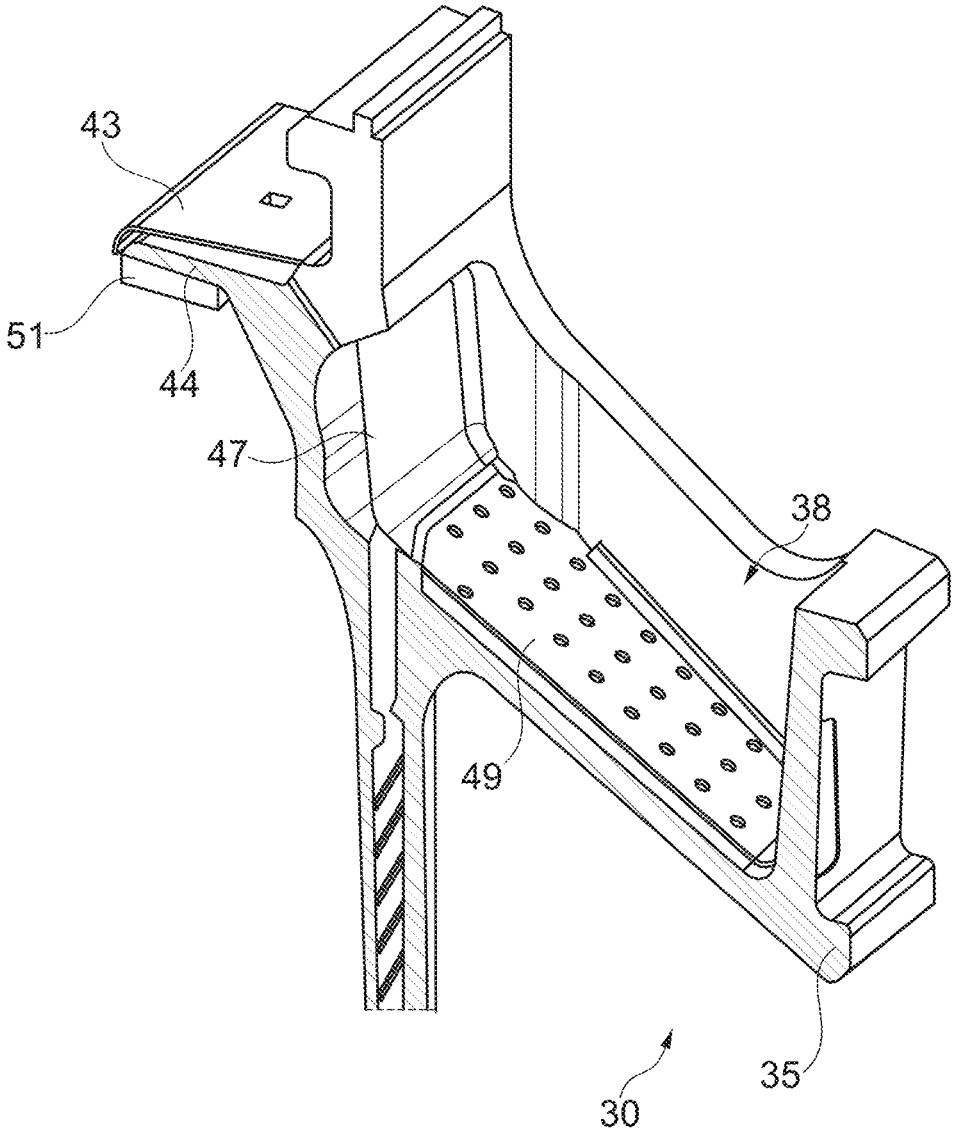
FIG. 5 shows in a perspective view the configuration of the outer platform of the vane of FIG. 3 with all screens put in place.

Another new feature of the design is also the provision of the projection 44 on the rear wall of the vane outer platform 35 equipped with a honeycomb 51 on the underneath (see FIGS. 3-5). The forward one of the teeth 52 of the outer blade platform 34, which prevents additional leakages of used-up air from the cavity 41 into the turbine flow path 39, is situated directly under the projection 44. Due to the presence of this projection, an additional gap (see FIG. 2, zone A) making way for cooling air leakages, is avoided.

Thus, efficient utilization of used-up cooling air makes it possible to avoid supply of additional cooling air to the stator heat shields 36 and to blade shrouds or outer blade platforms 34 because used-up air closes the cavity 41 effectively.

In summary, the proposed cooling scheme can have the following advantages:

1. Air used up in a vane 31 is utilized to cool parts, especially outer blade platforms 34.
2. There is no need in additional air for cooling the stator heat shields 36.
3. A projection 44, which is covered by a screen 43, generates a continuous air sheet of cooling air, which, in combination with the forward tooth 52 of the outer blade platform 34, closes the cavity 41 located between the teeth 52 on the outer side of the outer blade platforms 34.
4. The shape of the projection 44 on the outer vane platform 35 makes it possible to avoid additional cooling air leakages within the jointing zone (see A in FIG. 2) between the vanes 31 and the stator heat shields 36.
5. Used-up air penetrates through gaps between adjacent stator heat shields 36 into a backside cavity 42 (see FIG. 3) and prevents stator parts from being overheated.

Thus, a combination of vanes 31 with the projection 44 and a separate collector 46 to 48 for utilized air, as well as combination of non-cooled stator heat shields 36 and two-pronged outer blade platforms 34 with a cavity 41 formed between the outer teeth 52 of these outer blade platforms 34, enables a modern high-performance turbine to be designed.

LIST OF REFERENCE NUMERALS

10,30 gas turbine
11 compressor
12,16 fuel supply
13 burner
14,17 combustion chamber
15 high-pressure turbine
18 low-pressure turbine
19,40 vane carrier (stator)
20,32 blade
21,31 vane
22 machine axis
23,33 plenum
24,34 outer blade platform
25,35 outer vane platform
26,36 stator heat shield
27,37 hole
28,38 cavity
29,39 hot gas path
41,42,46 cavity
43,47,49 screen
44 projection
45 hole
48 shoulder
50 slit
51 honeycomb
52 tooth (outer blade platform)
TS turbine stage While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. An axial flow gas turbine comprising:

a rotor including alternating rows of air-cooled blades and rotor heat shields;

a stator including a vane carrier, alternating rows of air-cooled vanes, and stator heat shields mounted on the vane carrier, wherein the stator coaxially surrounds the rotor to define a hot gas path therebetween, such that the rows of blades and stator heat shields, and the rows of vanes and rotor heat shields, are opposite to each other, respectively, and wherein a row of vanes and an adjacent row of blades in the downstream direction define a turbine stage;

wherein the blades comprise tips and outer blade platforms at said tips;

at least one first cavity located between at least one of the outer blade platforms and at least one of the opposed stator heat shields;

means within at least one turbine stage for directing cooling air that has already been used to cool into said at least one first cavity, for protecting the stator heat shields against the hot gas and for cooling the outer blade platforms;

the vanes each comprising an outer vane platform;

the means for directing comprising a second cavity for collecting the cooling air which exits the vane airfoil;

the means for directing also comprising means for discharging the collected cooling air radially into said at least one first cavity;

a shoulder separating the second cavity from the rest of the outer vane platform; and a sealing screen closing off the second cavity.

2. The axial flow gas turbine according to claim 1, wherein the cooling air that has already been used to cool comprises cooling air already used to cool airfoils of the vanes of the turbine stage.

3. The axial flow gas turbine according to claim 1, wherein the outer blade platforms comprise parallel teeth on an outer side of the outer blade platforms extending circumferentially, and said at least one first cavity is bordered by said parallel teeth.

4. The axial flow gas turbine according to claim 1, wherein the discharging means comprises a projection at a rear wall of each outer vane platform which overlaps first teeth of the outer blade platform in the flow direction of outer blade platforms adjacent to the first teeth, and a screen which covers the projection such that a channel for the cooling air is formed between the projection and the screen which ends in a radial slot just above the at least one first cavity.

5. The axial flow gas turbine according to claim 1, further comprising:

a plurality of holes passing through the rear wall of the outer vane platform and are equally circumferentially spaced;

wherein the second cavity and the means for discharging are connected by said plurality of holes.

6. An axial flow as turbine comprising:

a rotor including alternating rows of air-cooled blades and rotor heat shields;

a stator including a vane carrier, alternating rows of air-cooled vanes, and stator heat shields mounted on the vane carrier, wherein the stator coaxially surrounds the rotor to define a hot gas path therebetween, such that the rows of blades and stator heat shields, and the rows of vanes and rotor heat shields, are opposite to each other, respectively, and wherein a row of vanes and an adjacent row of blades in the downstream direction define a turbine stage;

wherein the blades comprise tips and outer blade platforms at said tips and wherein the vanes comprise outer vane platforms;

at least one first cavity being located between at least one of the outer blade platforms and at least one of the opposed stator heat shields; and at least one slit being defined by a screen covering a projection at a rear wall of the outer vane platform of at least one of the vanes, each of the at least one slit being configured such that cooling air that has already been used to cool is directable into said at least one first cavity for protecting the stator heat shields against the hot gas and for cooling the outer blade platforms; and wherein the outer vane platform has a shoulder that partitions off a second cavity from the outer vane platform.

7. The axial flow gas turbine of claim 6, wherein the projection has a honeycomb that is adjacent to a tooth of the outer blade platform that is positioned underneath the projection.

8. The axial flow gas turbine of claim 7, wherein each of the at least one slit is configured to emit a continuous cooling air sheet of cooling air.

9. The axial flow gas turbine of claim 8, wherein the tooth and the cooling air sheet prevents hot gas from passing into the at least one first cavity, the at least one first cavity being located between teeth on an outer side of the blade platform.

10. The axial flow gas turbine of claim 6, wherein the projection is configured to avoid additional cooling air leakages within a joining zone between the vanes and the stator heat shields.

11. The axial flow gas turbine of claim 6, wherein the stator heat shields have gaps through which the cooling air pass for entering into a backside cavity to prevent stator parts from being overheated.

12. The axial flow gas turbine of claim 6, wherein the second cavity is closed off with a sealing screen such that cooling air passes from the second cavity through at least one hole toward the at least one slit.

13. The axial flow gas turbine of claim 12, wherein the projection has a honeycomb that is adjacent to a tooth of the outer blade platform that is positioned underneath the projection.

14. The axial flow gas turbine of claim 13, wherein the stator heat shields have gaps through which the cooling air pass for entering into a backside cavity to prevent stator parts from being overheated.

* * * * *